US005193466A

United States Patent [19]

Eder

[11] Patent Number: 5,193,466

[45] Date of Patent: Mar. 16, 1993

[54] CORRUGATED BOARD POP UP DISPLAY

[75] Inventor: John R. Eder, Prospect, Ky.

[73] Assignee: Diversified Advertising, Inc., Louisville, Ky.

[21] Appl. No.: 870,391

[22] Filed: Apr. 17, 1992

[51] Int. Cl.[5] ..... A47B 3/00

[52] U.S. Cl. ..... 108/111; 108/112

[58] Field of Search ..... 108/111, 110, 112, 53.1, 108/53.3, 91, 92; 211/72

[56] References Cited

U.S. PATENT DOCUMENTS

| | | | |
|---|---|---|---|
| 3,549,019 | 12/1970 | Wood | 108/111 X |
| 3,687,091 | 8/1972 | Boylan | 108/111 X |
| 3,756,581 | 9/1973 | Albertini | 108/111 X |
| 3,845,727 | 11/1974 | Chase | 108/111 |
| 4,151,003 | 5/1979 | Ferrera et al. | 108/111 X |
| 4,493,424 | 1/1985 | Smith | 108/111 X |
| 4,582,003 | 4/1986 | Valero | 108/111 |
| 4,605,130 | 8/1986 | Taub | 211/72 X |
| 4,632,345 | 12/1986 | Barley | 108/111 X |
| 5,076,177 | 12/1991 | Chien | 108/111 |

*Primary Examiner*—Jose V. Chen

*Attorney, Agent, or Firm*—Middleton & Reutlinger

[57] ABSTRACT

A collapsible corrugated board pop up display having a plurality of horizontal shelves hingeably connected to a folding back panel having a top and bottom portion. A pair of top and bottom side panels are pivotally connected to the top and bottom back panels respectively. The top and bottom side panels have recesses and projections forming a tongue and groove arrangement for connecting the top side panels with the bottom side panels. The front portion of the bottom shelf is supported by a collapsible reinforcement base member extending between and attached to the bottom side panels. The front portion of each one of the remaining shelves is supported by a flexible structure such as a cord affixed to opposite side walls and positioned beneath each shelf to provide support for the shelf in the horizontal "in use" position.

14 Claims, 4 Drawing Sheets

CORRUGATED BOARD POP UP DISPLAY

BACKGROUND OF THE INVENTION

The present invention relates to a portable corrugated board pop up display for shelving.

Corrugated board shelving displays known in the art are used for temporary shelving to display merchandise in stores, trade shows, and even home use. Although collapsible corrugated board shelving is known in the art, the commercially available corrugated board shelving assemblies are limited in height and the number of shelves the units will support due to structural design and the limitations of structural strength inherent in using corrugated board for construction of the units.

The collapsible display of the present invention is constructed using multi-layer corrugated board. The display includes a folding back panel having a top and bottom panel hingeably connected together with a horizontal crease forming a living hinge. The top and bottom back panels are supported by top and bottom side panels which are removably connected together by a tongue and groove means, more specifically, removable tab projections in the upper side panels which are inserted into complementary shaped and sized recesses to provide longitudinal and lateral support of the display when in use. The side panels support a plurality of shelves hingeably connected to the top and bottom back panels. The pop up display is designed to maximize available shelf space in an inexpensive, yet portable unit, which is sturdy and capable of being collapsed into a small unit for transporting and/or reuse.

It is the objective of the present invention to provide a collapsible corrugated board shelving assembly designed having a top and bottom portion hingeably connected together to support a plurality of shelves.

Another objective of the invention is to provide a means of integrally connecting the top and bottom side panels in a manner using complementary shaped tabs and recesses to provide lateral stability and support using the corrugated board and without the use of additional materials.

A further objective of the invention is to provide a design which can be folded into a compact unit capable of being transported and reassembled by one person, and to be stacked and/or shipped using a minimum of space.

It is an object of the present invention to design a collapsible display featuring scores strategically positioned between the side panels and the back panel providing a connection means having an angle of greater than 90 degrees to accommodate the bulk of the shelves when the display is in the collapsed position, yet provide maximum structural strength in the erected "in use" position.

It is yet another object of the present invention to provide a collapsible display featuring a bottom surface shelf pull-out to provide a means for attachment of advertising material such as stickers, names, logos, etc.

SUMMARY OF THE INVENTION

The present invention is a collapsible corrugated board pop up display having a plurality of horizontal shelves hingeably connected to a folding back panel. The folding back panel is comprised of a top and bottom portion connected by a living hinge. A pair of top and bottom side panels are pivotally connected to the top and bottom back panels, respectively. The top and bottom side panels have recesses and projections forming a tongue and groove arrangement for connecting the top side panels with the bottom side panels. The front portion of the bottom shelf is supported by a collapsible reinforcement base member extending between and attached to the bottom side panels. The front portion of each one of the remaining shelves is supported by a flexible means such as a cord affixed to opposite side walls and positioned beneath each shelf to provide support for the shelf in the horizontal "in use" position.

The pop up display is collapsed by folding the shelves upward against the back surface, disjoining the top and bottom side walls from one another, folding the side walls inward toward one another over the shelves and collapsing the bottom base member, and folding the top portion of the back panel together with the bottom portion of the back panel.

The pop up display is fabricated from a sheet of corrugated cardboard cut to form single and double panels. Reinforcement pieces of corrugated board are sandwiched between the panels for additional structural support.

BRIEF DESCRIPTION OF THE DRAWINGS

A better understanding of the present invention will be had upon reference to the following description in conjunction with the accompanying drawings in which like numerals refer to like parts throughout the several views and wherein.

PREFERRED EMBODIMENT

The portable collapsible corrugated board pop up display of the present invention is designed having a plurality of horizontal shelves hingeably connected to a folding back and side panels.

In the preferred embodiment, the display is fashioned from 200 pound, grade "B" fluted corrugated cardboard; however, the size, weight and thickness of the sheet is arbitrary and determined by the user's requirements. It is contemplated that the display could be constructed of plastic materials such as styrofoam, plastic or film covered corrugated board, or plastics comprised of structural foam.

Figure 1:
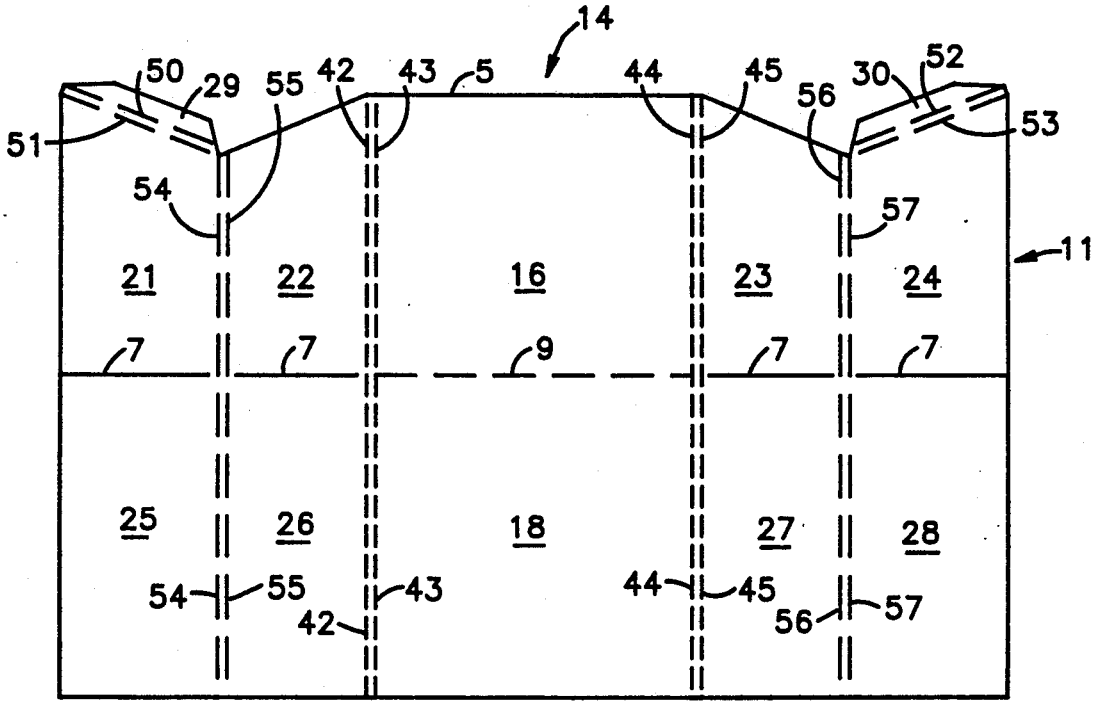
FIG. 1 is a plane view of the corrugated board sheet comprising the back, side, and top panels of the display of the present invention, showing the position of seams, edges, scores, and creases which form the panels of the display.

As shown in FIG. 1, the back panels, the side panels, and the top side flaps are of integral construction formed from a single sheet 11 of corrugated board material having an interior surface 13 (shown in FIG. 1) and an exterior surface 15 (not shown). The corrugated board sheet 11 is substantially rectangular in shape and of generally uniform thickness to maximize the structural strength of the corrugated board and minimize waste material. The rectangular sheet 11 is cut around the periphery 5 to form the top, sides, and bottom edges of the display 10. An additional cut 7 extends midway along the horizontal plane from each side of the back panel 14 outward through the side panels, separating the side panels into top and bottom side panels. These cuts form the top left outer side panel 21, the top left inner side panel 22, the back panel 14, the top right inner side panel 23, the top right outer side panel 24, the bottom left outer side panel 25, the bottom left inner side panel 26, the bottom right inner side panel 27, the bottom right outer side panel 28, the top left side flap 29, and the top right side flap 30.

A back panel exterior crease 9 extends horizontally along the exterior surface 15 near the middle of the sheet 11 in alignment with cut 7, thereby a forming a top back panel 16 and bottom back panel 18 from back panel 14. The crease 9 forms a living hinge pivotally connecting the top back panel 16 and the bottom back panel 18. The top back panel 16 can be pivoted backward so that the exterior surface 15 of the top back panel 16 is contiguous with the exterior surface 15 of the bottom back panel 18 to facilitate collapsing of the display 10 for storage or transporting.

As illustrated in FIG. 1, a pair of spaced apart, parallel, longitudinal scores (left outer interior score 42 and left inner interior score 43) are cut into the interior surface 13 and exterior surface 15 of the sheet 11 between the top left inner side panel 22 and the top back panel 16, and between the bottom left inner side panel 26 and the bottom back panel 18 pivotally connecting the side panels 22 and 26 with back panels 16 and 18, respectively. A pair of spaced apart, parallel, longitudinal scores (right inner interior score 44 and right outer interior score 45) are cut into the interior surface 13 and exterior surface 15 of the sheet 11 between the top back panel 16 and the top right inner side panel 23, and between the bottom back panel 18 and the bottom right inner side panel 27 pivotally connecting side panels 23 and 27 with back panels 16 and 18, respectively.

Figure 6:
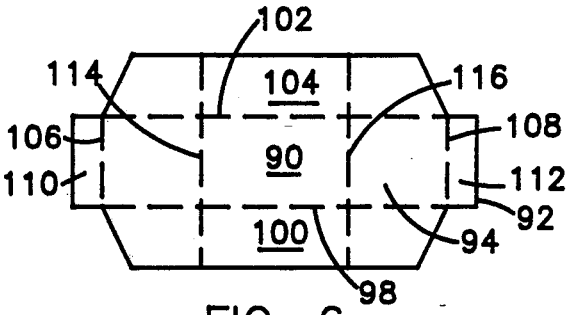
FIG. 6 is a plane view of the corrugated board sheet comprising the reinforcement base panel of the display of the present invention, showing the position of the creases and flaps which form the panels.
Figure 7:
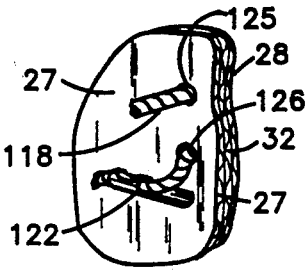
FIG. 7 is a perspective view of a side panel of the display of the present invention showing the cord being passed from the inner portion of the panel through a hole of in the side panel and back through the side panel where the cord is removably secured against the inner surface of the side panel of the display.

The spacing between scores 42 and 43 provides an obtuse angle to accommodate bending of the top left inner side panel 22 inward toward the top back panel 16, and bending of the bottom left inner side panel 26 inward toward the bottom back panel 18. Likewise, scores 44 and 45 provide an obtuse angle to accommodate bending of the top right inner side panel 23 inward toward the top back panel 16, and bending of the bottom right inner side panel 27 inward toward the bottom back panel 18. The incorporation of spaced apart scores (42, 43, 44, and 45) in both the interior surface 13 and exterior surface 15 of the sheet 11 is an important design feature with respect to prior art display devices, in that the present invention spaces the scores (42 and 43), and scores (44 and 45) to provide angles that are greater than 90 degrees to prevent crimping of the interior surface 13, exterior surface 15 and medial corrugated layer 17 (not shown) of sheet 11, and thereby maximize the strength of the corrugated board material. Upon folding the top left inner side panel 22 and bottom left inner side panel 26 inward toward top and bottom back panels 16 and 18, respectively, a space is provided to accommodate the folded shelves 12; thereby eliminating the need to crimp the corrugated board to fold the portable display 10 into the collapsed position as shown in FIGS. 6 and 7. The space between the scores (42 and 43) and (44 and 45) may be varied to accommodate the thickness of individual or a plurality of shelves.

As shown in FIG. 1, the top left side flap 29 is folded over and glued so that the exterior surface 15 of the top left side flap 29 is contiguous with the exterior surface 15 of the top left outer side panel 21; thereby forming a pair of spaced apart parallel creases, upper left diagonal exterior crease 50 and lower left diagonal exterior crease 51, on the exterior surface 15 of the sheet 11. Likewise, the top right side flap 30 is folded over and glued so that the exterior surface 15 of the top right side flap 30 is contiguous with the exterior surface 15 of the top right outer side panel 24; thereby forming a pair of spaced apart parallel creases, upper right diagonal exterior crease 52 and lower right diagonal exterior crease 53, on the exterior surface 15 of the sheet 11. The double creases formed into the surface of the sheet 11 in the display 10 alleviate crimping of the corrugated board sheet 11 upon folding and provide space for the insertion of additional reinforcement panels between the side panels. Folding of top left side flap 29 and top right side flap 30 forms smooth top side surface edges which enhances the appearance of the display 10, prevents snagging of cut edges during use, and the overlapping of the corrugated board material provides additional structural strength to the display 10.

A pair of spaced apart parallel creases, (left side panel outer exterior crease 54 and left side panel inner exterior crease 55) are formed in the exterior surface 15 of the sheet 11, extending longitudinally between the (top left outer side panel 21 and bottom left outer side panel 25) and the (top left inner side panel 22 and bottom left inner side panel 26). Likewise, a pair of spaced apart parallel creases, (right side panel inner exterior crease 56 and right side panel outer exterior crease 57) are formed in the exterior surface 15 of the sheet 11, extending longitudinally between the (top right inner side panel 23 and bottom right inner side panel 27) and the (top right outer side panel 24 and bottom right outer side panel 28). The double creases formed into the surface of the sheet 11 in the display 10 alleviate crimping of the corrugated board sheet 11 upon folding the exterior surfaces 15 of (side panel 21 together with side panel 22, side panel 25 together with side panel 26, side panel 23 together with side panel 24, and side panel 27 together with side panel 28), and provide a space which can be varied for the insertion of additional reinforcement panels between the side panels. Folding of panels 21 and 22, 25 and 26, 23 and 24, and 27 and 28, forms double side panels having a smooth front side surface edges which enhances the appearance of the display 10, prevents snagging of cut edges during use, and the overlapping of the corrugated board material provides additional structural strength to the display 10.

Figure 4:
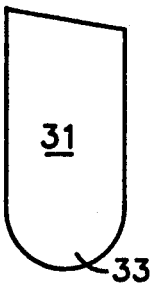
FIG. 4 is a side plane view of the reinforcement panel of the display of FIG. 1 which is inserted between the top inner and outer side panels.
Figure 5:
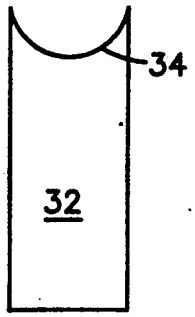
FIG. 5 is a side plane view of the reinforcement panel of the display of the present invention which is inserted between the bottom inner and outer side panels of the display of FIG. 1.
Figure 8:
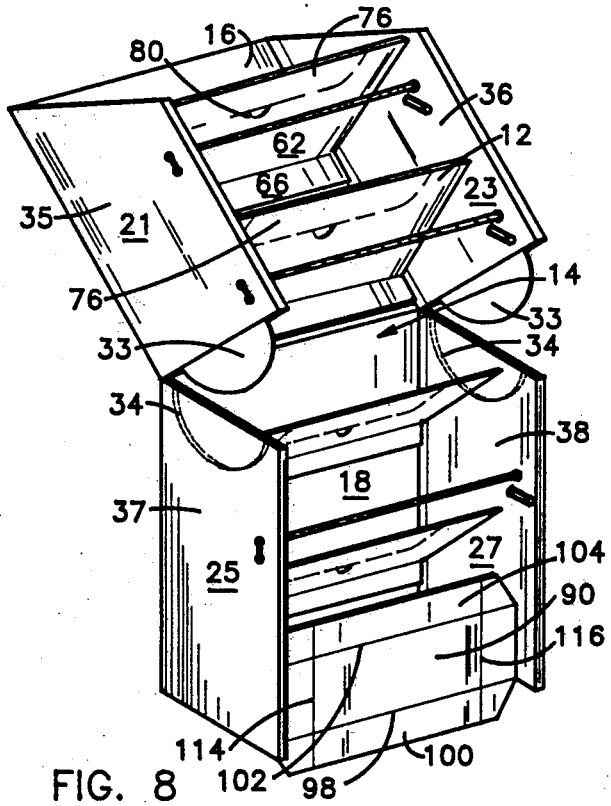
FIG. 8 is a perspective view of the display of the present invention showing pivoting of the back panels and the partial disassembly of the top and bottom side panels and the tabs and recesses (shown in phantom view), the shelves in an intermediate position, and the panels comprising the reinforcement base panel member.
Figure 9:
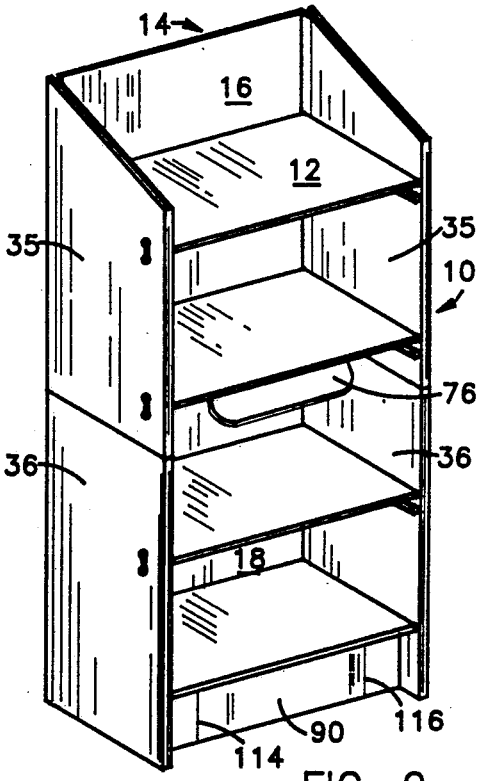
FIG. 9 is a perspective view of the display shown in FIG. 8 showing the display in the erected "in use" position with the shelves in the horizontal, rigid position.

As shown in FIG. 8, a top reinforcement medial side panel 31, FIG. 4, is inserted and glued to the exterior surface 15 of sheet 11 between the top left outer side panel 21 and the top left inner side panel 22, and between the top right inner side panel 23 and the top right outer side panel 24. The addition of the reinforcement panels 31 forms a top left triple ply side panel 35 and a top right triple ply side panel 36 as shown in FIGS. 7 and 8. A bottom reinforcement medial side panel 32, FIG. 5, is inserted and glued to the exterior surface 15 of sheet 11 between the bottom left outer side panel 25 and the bottom left inner side panel 26, and between the bottom right inner side panel 27 and the bottom right outer side panel 28 as shown in FIGS. 7 and 8. The addition of the reinforcement panels 32 forms a bottom left triple ply side panel 37 and a bottom right triple ply side panel 38 as shown in FIG. 8.

Each of the top reinforcement panels 31 have a projection or tab extending downward from the lower portion of the panels 31 forming a tongue 33 which is complementary sized and shaped to fit within a recess or groove 34 formed in the upper portion of the bottom reinforcement panels 32. In the up-right "in use" position, the tongues 33 are removably inserted within the grooves 34 to provide structural support and lateral stability to the display 10.

The tongue and groove feature is of particular importance in that it enables the multi-shelf display 10 to be folded into a collapsible position having only ½ the height of the upright display 10 for storage, yet the tongue and groove assembly provides a means to maintain the structural strength required for the upright "in use" position. As shown and described the display 10 of the present invention utilizes projections extending from the top side panels; however, it is contemplated that the display 10 could be constructed having recesses in the top panels and projections extending from the bottom panels, or any combination thereof.

The display 10 also incorporates a collapsible base panel member 90, attached to the interior surface 13 of the bottom left inner side panel 26 and bottom right interior side panel 28, and rests on the floor surface as shown best in FIGS. 6 and 8. The base panel member 90 is comprised of a single sheet of corrugated board sheet 92 having an interior base surface 94 facing outward forming the front of the display 10, and an exterior base surface 96 (not shown) facing the bottom back panel 16.

The base panel member 90 is unique in that a plurality of creases formed in the sheet 92 render the base panel member 90 collapsible, yet the strategic location of the creases provides for angular support of the base panel member 90 in the extended "in use" position.

As shown in FIG. 6, a front bottom crease 98 is formed in the exterior surface 96 of the sheet 92 extending in the horizontal plane from the left bottom inner side panel 26 to the right bottom inner side panel 28. The sheet 92 is bent inward along the bottom front crease 98 at approximately a right angle of 90 degrees forming a bottom base panel portion 100.

Figure 2:
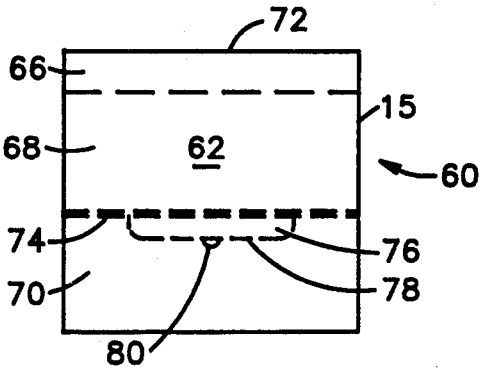
FIG. 2 is a plane view of the corrugated board sheet comprising the top, bottom, attachment, and detachable folding panels of the display of the present invention, showing the position of the creases and scores which form the panels of the shelf.

As best shown in FIG. 2, a plurality of shelves 12 are attached to the inner surface of the back panel 14. Each shelf 12 is cut from a corrugated board sheet 60 having an exterior surface 62 and an interior surface 64 (not shown). FIG. 2 shows the shelf 12 having a rear portion 66, a mid-portion 68, and a front portion 70 separated by creases formed in the interior surface 64 of the shelf 12. A horizontal interior back crease 72 extends between the rear portion 66 and the mid-portion 68. A horizontal interior front double crease 74 extends between the mid-portion 68 and the front portion 70 of the shelf 12.

Figure 10:
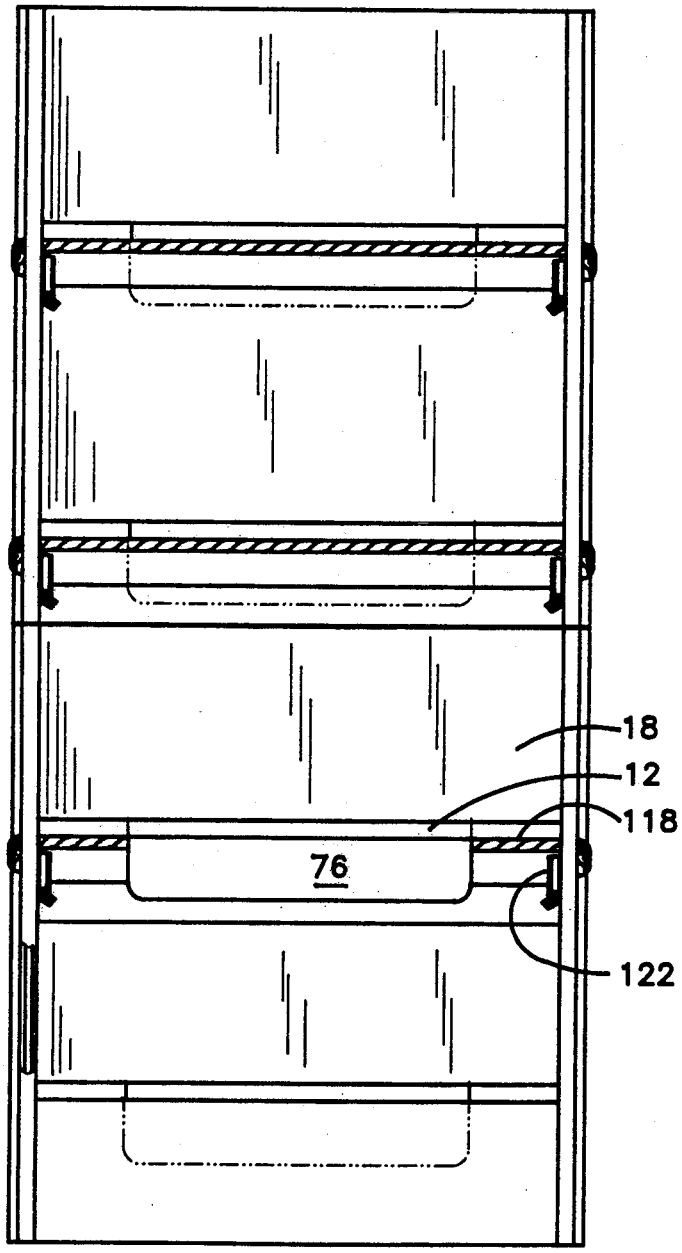
FIG. 10 is a front plane view showing the display of the present invention in the upright "in-use" position with the shelves lowered in the horizontal plane and the detachable folding panel in the "down" position.

A substantially rectangular shaped detachable folding panel 76 is formed in the shelf 12 by scoring the exterior surface 64 of the front portion 70. As shown in FIGS. 2 and 10, the score line 76 extends from the horizontal interior front double crease 74. A pull tab section 80 is scored in the exterior surface 64 of the front portion 70 near the center of the folding panel 76 to facilitate detachment of the folding panel 76 from the shelf 12.

Figure 3:
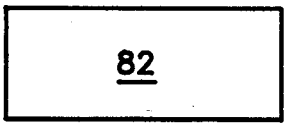
FIG. 3 is a plane view of the reinforcement panel of the display of the present invention which is inserted between the top and bottom shelf panels of FIG. 2.

In the preferred embodiment, a corrugated board reinforcement sheet 82, as shown in FIG. 3, is sandwiched between and glued to the interior surface 64 of the front portion 70 and mid-portion 68 of the shelf sheet 60. The width of the reinforcement sheet 82 is slightly less than width of the mid-portion 68 and front portion 70, so that bending sheet 60 along the horizontal interior front double crease 74 does not crimp the corrugated board. The design of the shelf 12 incorporating the reinforcement sheet 82 within the double crease 74 is an important feature of the present invention to prevent deformation of the corrugated board and maximize the structural strength of the shelves 12. The exterior surface 62 of the rear portion 66 is adhesively attached in a horizontal plane to the back panel 14 of the display 10 at a selected position along the longitudinal axis of the display 10. The exterior surface 62 of the mid-portion comprises the top surface 84 of the shelf 12, while the exterior surface 62 of the front portion 70 comprises the bottom surface 86 of the shelf 12.

As shown best in FIGS. 8 and 10, the front portion of the bottom shelf 120 is supported by the collapsible reinforcement base panel member 90 attached to and extending between bottom left panel 37 and bottom right panel 38. The front portion of each one of the remaining shelves 12 is supported by a flexible support means such as a cord 118.

Each cord 118 of the present invention is made from synthetic fiber; however, it is contemplated that the cord could be manufactured from natural or synthetic material or any flexible material, or that a flexible strap would work as well. FIG. 7 shows the preferred method of attachment of the cords 118 to the bottom right triple ply side panel 38. As shown in FIG. 7, a metal or plastic end sheath 122 is removably attached to each end of the cord 118. Although a knot in the end of the cord 118 would secure the cord between the side panels, the sheath 122 facilitates threading of the cord through a top hole 124 and a bottom hole 126 cut into each one of the side panels 35, 36, 37, and 38, respectively. For example, the tip of the cord 118 is threaded through a top hole 125 on the interior of the bottom right triple side panel 38, whereby the cord 118 is extended downward and threaded back through a bottom hole 126 of the exterior of the bottom right triple side panel 38, wherein the sheath is positioned perpendicular to the cord 118 to prevent the tip of the cord 118 from retracting. Looping the cord 118 through the panel dissipates the stress over a larger surface area of the corrugated board construction of the panels, and provides an aesthetic appearance hiding the cord 118 fastening means 122 from a side view of the display 10.

The cords 118 are positioned near the front of the shelf 12 and slightly below the horizontal plane of each shelf 12 to provide a means of support for each of the shelves 12 upon lowering the shelves 12 to the horizontal "in use" position. As shown in FIGS. 7, 8, 9, 10, and 12, the cords 118 are removably attached to the opposite side walls of the top side panels 35 and 36, and between the bottom side panels 37 and 38. The cords 118 located near the outer edge of the side panels (35, 36, 37 and 38) serves to limit the outward movement of the side panels (35, 36, 37, and 38). Lowering of the shelves 12, to the horizontal position spreads the side panels (35, 36, 37, and 38) apart resulting in tension being placed on the cord 118 due to the contact of the lateral side edges of the shelf 12 above the cord 118 with the side panels, 37 and 38, and 35 and 36, thereby providing support for the front portion of the shelves 12 as shown in FIG. 10. An important feature of the shelf 12 support assembly is the design which utilizes the additional weight of the material on the shelf to provide additional tension on the cords 118 holding the shelf 12 even tighter between the side panels to hold each shelf 12 rigidly in the horizontal "in use" position.

FIG. 10 shows the display 10 in the upright position with the shelves 12 lowered in the horizontal plane in the "in use" position. The third shelf 12 from the top illustrates the detachable folding panel 76 in the "down" position.

Figure 11:
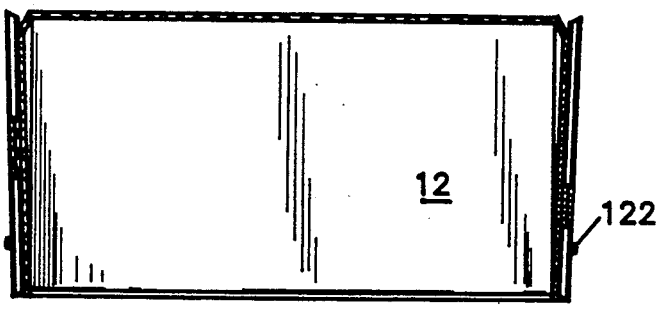
FIG. 11 is a front plane view showing a shelf of the display of the present invention, wherein the shelf is in the "upright" collapsed position, and the cord is contained between the shelf and back panel.

FIG. 11 shows a shelf 12 in the "upright" collapsed position, whereby the cord 118 is contained between the shelf 12 and back panel 14.

Figure 12:
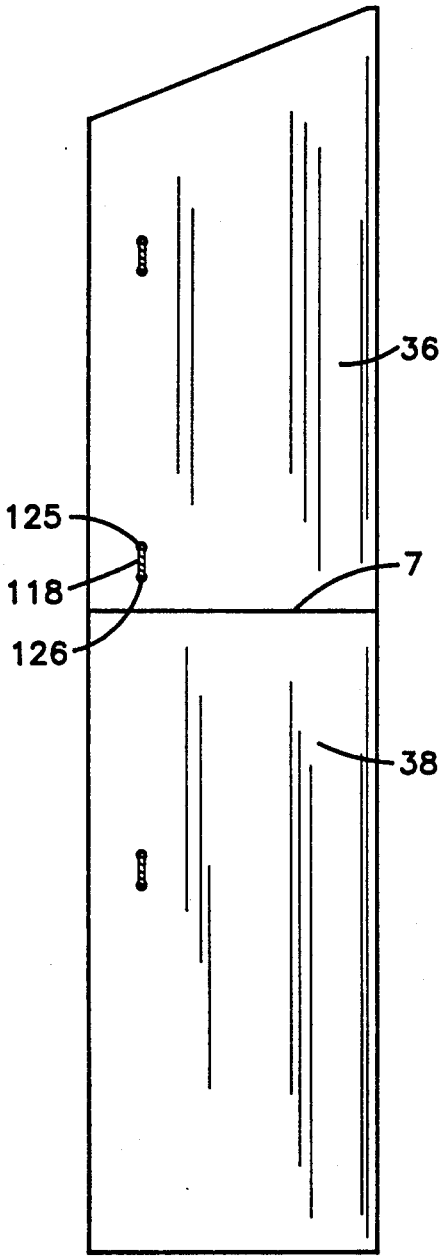
FIG. 12 is a right exterior side view showing the display of the present invention in the "upright" position showing the right top and bottom side panels, and the position of the cords with respect to the division of the panels.

FIG. 12 is a right exterior side view of the display 10 in the upright position showing the right top and bottom side panels 36 and 38, respectively, and the position of the cords 118 with respect to the division of the panels.

Figure 13:
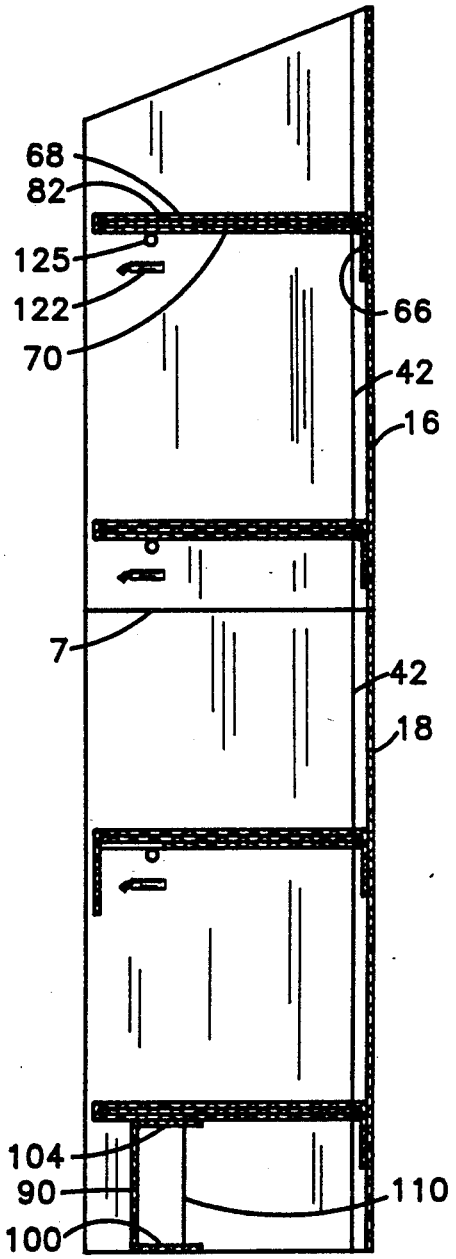
FIG. 13 is a cut-away left interior side view of the upright display of FIG. 12 showing the triple ply shelf, the single ply back panel, attachment of the shelf to the back panel, support of the shelves by the cords, the cord sheath attachment means, and the features the bottom reinforcement base panel.

FIG. 13 is a cut-away left interior side view of the upright display of FIG. 12 showing the triple ply shelf 12, the single ply back panel 14, attachment of the shelf 12 to the back panel 14, support of the shelves 12 by the cords 118, the cord sheath attachment means 122, and the features comprising the bottom reinforcement base panel 90.

The display 10 is collapsed by simply folding the shelves 12 upward to lie flat against the back panel 14, folding the side panels 35, 36, 37, and 38 inward to hold the shelves 12 in the upright position and collapse the reinforcement base panel 90, and folding the top portion of the display backward and downward to lie substantially flat against the bottom portion of the display 10.

Figure 14:
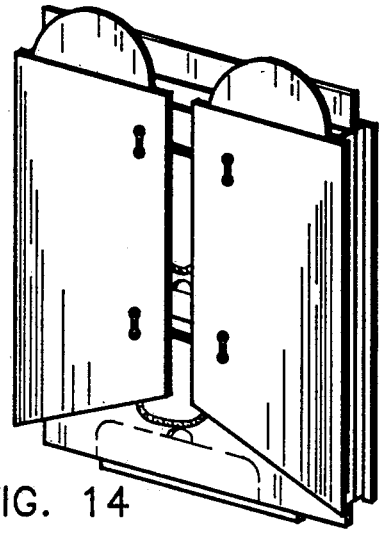
FIG. 14 is a perspective view of the display of the present invention showing the display in the collapsed position with the top side panels folded inward over the top shelves.
Figure 15:
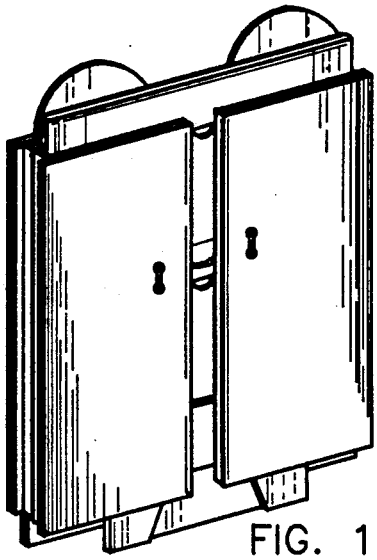
FIG. 15 is a perspective view of the display of the present invention showing the display of FIG. 14 at a 180 degree rotation illustrating the bottom panels folded inward over the bottom shelves.

FIG. 14 shows the display 10 in the collapsed position with the top side panels 35 and 36 folded inward over the top shelves 12, and FIG. 15 shows a 180 degree rotation of the display 10 illustrating the bottom panels 37 and 38 folded inward over the bottom shelves 12.

The foregoing detailed description is given primarily for clearness of understanding and no unnecessary limitations are to be understood therefrom, for modification will become obvious to those skilled in the art based upon more recent disclosures and may be made upon departing from the spirit of the invention and scope of the appended claims.

I claim:

1. A collapsible corrugated board display, comprising:

a vertically disposed folding back panel including a top back panel and a bottom back panel;

means for pivotally connecting said top back panel and said bottom back panel along a horizontal axis;

a plurality of spaced apart horizontal shelves;

means for hingeably connecting said horizontal shelves to said folding back panel;

a top left side panel and a top right side panel pivotally connected to said top back panel, and a bottom left side panel and a bottom right side panel pivotally connected to said bottom back panel;

means for removably securing the bottom of said top left side panel to the top of said bottom left side panel, and the bottom of said top right side panel to the top of said bottom right side panel;

a collapsible reinforcement base member extending between and attached to said bottom side panels;

a flexible support means extending between and attached to said left and right top side panels, and extending between and attached to said left and right bottom side panels, said flexible support means being under tension when said shelf thereabove is extended to a horizontal position, the tension being created by contact of the lateral side edges of the shelf immediately above said flexible support means with said side panels, each said flexible support means serving to support a shelf thereabove and whatever may be on said shelf and serving to hold and support said side panels in position; and said display being collapsible with each shelf pivoting upwardly to lie generally parallel to said top back panel and said bottom back panel, and with said top side panels pivoting inwardly to lie generally parallel to said top back panel, and said bottom side panels pivoting inwardly to lie generally parallel to said bottom back panel, sandwiching said shelves between said side panels and said back panels, and pivoting said top back panel with said top shelves and top side panels rearward adjacent said bottom back panel.

2. The collapsible corrugated board display of claim 1, wherein said top back panel, said bottom back panel, said top left flap panel, said top right side flap, said top left side panel, said top right side panel, said bottom left side panel, and said bottom right side panel are cut from a single sheet of corrugated board.

3. The collapsible corrugated board display of claim 1, wherein each one of said top side panels and said bottom side panels include at least one reinforcement sheet of corrugated board sandwiched between an outer side panel and an inner side panel.

4. The collapsible corrugated board display of claim 1, wherein said means for removably securing the bottom of said top left side panel to the top of said bottom left side panel, and the bottom of said top right side panel to the top of said bottom right side panel includes said left top side panel and said right top side panel having at least one projection extending therefrom forming a tongue, and said bottom left side panel and said bottom right side panel having a recess complementary shaped and sized to accommodate said tongue for removably connecting said left top side panel with said left bottom side panel and said right top side panel with said right bottom side panel.

5. The collapsible corrugated board display of claim 1, wherein said means for pivotally connecting said top back panel and said bottom back panel allow a horizontal axis comprises a horizontal crease extending horizontally along the exterior surface near the middle of said vertically disposed back panel thereby a forming a living hinge pivotally connecting said top back panel and said bottom back panel.

6. The collapsible corrugated board display of claim 1, wherein a pair of spaced apart, parallel, longitudinal scores are cut into the surface of said corrugated board between said top side panels and said top back panel, and between said bottom side panels and said bottom back panel, for pivotally connecting said side panels with said back panels, whereby the spacing between each pair of scores provide an obtuse angle to accommodate pivoting of said side panels inward toward said back panels, said pair of scores providing a space to accommodate the folded shelves and preventing crimping of said corrugated board.

7. The collapsible corrugated board display of claim 1, including a top left side flap and a top right side flap being folded over forming left and right smooth top side panel edges.

8. The collapsible corrugated board display of claim 1, wherein said shelf includes a reinforcement corrugated board panel sandwiched between a top shelf panel and a bottom shelf panel.

9. The collapsible corrugated board display of claim 1, wherein each of said shelves have a detachable folding panel formed within, including a pull tab section for displaying labels or attachment of advertisements thereto.

10. The collapsible corrugated board display of claim 1, wherein said collapsible reinforcement base member includes a top panel for supporting the front portion of a bottom shelf and a bottom panel in contact with the floor surface.

11. The collapsible corrugated board display of claim 1, wherein said flexible support member comprises a cord affixed to opposite side panels and positioned beneath the front portion of an upper shelf to provide support for said shelf in the horizontal position.

12. The collapsible corrugated board display of claim 11, including an end sheath attached to the tip of said cord.

13. The collapsible corrugated board display of claim 1, wherein said side panels have a pair of spaced apart holes therein, one below the other, near the front edge, positioned beneath the front portion of said shelf for attachment of said cord.

14. The collapsible corrugated board display of claim 1, wherein said means for hingeably connecting said horizontal shelves to said folding back panel includes a flap attached to and extending perpendicular along the rear of said horizontal shelves affixed to said back panel.

* * * * *

UNITED STATES PATENT AND TRADEMARK OFFICE

CERTIFICATE OF CORRECTION

PATENT NO. : 5,193,466

DATED : March 16, 1993

INVENTOR(S) : John R. Eder

It is certified that error appears in the above-identified patent and that said Letters Patent is hereby corrected as shown below:

Column 9, line 29, delete [allow] and insert therefor --along--.

Signed and Sealed this

Eighth Day of March, 1994

Bruce Lehman

*Attest:*

BRUCE LEHMAN

*Attesting Officer*

*Commissioner of Patents and Trademarks*